US005369579A

United States Patent [19]

Anderson

[11] Patent Number: 5,369,579

[45] Date of Patent: Nov. 29, 1994

[54] ELECTRONIC BLAST CONTROL SYSTEM FOR DOWNHOLE WELL OPERATIONS

[76] Inventor: Otis R. Anderson, 5355 Anderson Rd., Houston, Tex. 77053

[21] Appl. No.: 150,610

[22] Filed: Jan. 24, 1994

[51] Int. Cl.[5] ..... E21B 43/1185

[52] U.S. Cl. ..... 364/422; 175/4.54

[58] Field of Search ..... 364/422, 423; 175/4.54; 166/63; 102/312, 313, 206, 270

[56] References Cited

U.S. PATENT DOCUMENTS 4,572,288 2/1986 Kinley ..... 166/63
4,869,171 9/1989 Abouav ..... 102/206
4,971,160 11/1990 Upchurch ..... 175/4.54

*Primary Examiner*—Donald E. McElheny, Jr.
*Attorney, Agent, or Firm*—James L. Jackson

[57] ABSTRACT

A method and apparatus for safely controlling detonation of a downhole explosive energized device which ensures that the explosive can be detonated in a well bore only when downhole hydrostatic pressure and well fluid temperature are within limits reflecting location of the explosive energized device at designed depth for accurate positioning relative to a selected formation. The apparatus further employs a clock/timer circuit and a motion sensor circuit to ensure firing of the explosive device only within a predetermined time period and only after having remained stationary within the well casing for a predetermined period of time. The apparatus further includes a memory circuit which receives and stores pressure and temperature data sets correlated with time which reflect well conditions before and after firing of the explosive device. After the tool has been retrieved from the well, this data is copied from the tool memory to a computer memory for subsequent computer processing and display.

18 Claims, 1 Drawing Sheet

ELECTRONIC BLAST CONTROL SYSTEM FOR DOWNHOLE WELL OPERATIONS

FIELD OF THE INVENTION

This invention relates generally to subsurface operations which are carried out in a well bore by means of one or more explosive charges which are typically contained within a blast joint and are electronically initiated for doing such work as perforation of well casing by means of shaped charges, setting of packers by means of explosive generated pressure, and for accomplishing any number of other downhole well activities. More specifically, the present invention concerns a method and apparatus for electronically controlling downhole blasting operations to ensure safe and timely positioning of the explosive device at a predetermined depth within a well bore or well casing and safely firing the explosive device to achieve the intended work. This invention also concerns an electronic blast control system that effectively prevents detonation of the explosive device at any point of its insertion into the well bore or retrieval from the well bore if retrieved without detonation. The invention further concerns the provision in a downhole electronic blast control system of a solid state, non-volatile electronic memory for acquiring and storing multiple sets of downhole data before, during and after explosive detonation and which is dumped to a computer memory after recovery of the tool from the well bore for subsequent computer analysis.

BACKGROUND OF THE INVENTION

As mentioned above, many different types of downhole activities in well bores are conducted through utilization of the energy developed by first or second order initiation of an explosive substance. For example, in the completion of wells a blast joint incorporating multiple shaped charges is detonated at a desired downhole depth causing the shaped charges to perforate the well casing and cement casing lining and also penetrate a desired lateral depth into the surrounding formation. Explosive well completion devices are also employed which cause explosive movement of projectiles from a perforation tool laterally through the well casing and into the surrounding formation. These perforations permit petroleum products contained within the formation to be channeled into the well casing for production through production tubing to surface located production equipment. Explosive initiated well tools are also employed for the purpose of setting and releasing packers for sealing off between the well casing and production tubing extending through the casing. Packers are often employed to isolate a section of the well casing traversing a production formation to thereby insure that only a limited section of the well casing is pressurized by the production pressure of the formation.

Since the handling of explosives is an inherently dangerous activity, for the protection of personnel and equipment from the adverse effects of undesired explosive detonation it is highly desirable to provide a firing control system that permits firing of the explosive only under strictly controlled circumstances. It is imperative that a downhole explosive device be permitted to fire only when it is properly located at designed depth within the well; otherwise, the well casing could be perforated at the wrong depths or well service personnel could experience significant danger.

At the present time, downhole explosives are set off or fired primarily by mechanical means. An explosive device may be controlled by shear pins which prevent detonation of the explosive until one or more shear pins are sheared through controlled mechanical operation of downhole blast control equipment. Under certain circumstances, a bullet type downhole device may be struck by a suitable firing device for initiation of a detonator that will in turn, achieve first order detonation of the explosive controlled device. As a further alternative, a ball or bar may be dropped within a firing string positioned within the well bore to move a mechanical device to its firing position. The prior art further includes downhole firing control devices that are controlled by pressure, time, and motion. An even further type of downhole explosive control device incorporates a ratcheting system to accomplish release of a spring-loaded firing pin to set off a detonator for the explosive. This type of ratcheting device is activated by using the wireline of a downhole explosive control system to pick up and set down a specific number of times to determine the number of ratchets that occur before the firing pin of the explosive device is released for detonation of the explosive.

The existing techniques for handling explosive devices in the downhole environment are subject to significant disadvantages. If, for some reason, an explosive device is positioned within a well bore and fails to fire or for some reason is not fired, it must be retrieved from the well bore in its unfired condition. Many wells have been seriously damaged when an unfired explosive device is inadvertently fired or fires of its own accord during retrieval from the well bore. This type of undesirable explosive firing is seriously disadvantageous when the explosive apparatus being retrieved is a casing perforation system. In the case of perforating strings or blast joints the well casing can be perforated at an undesired depth, requiring expensive and time consuming repairs. Also, in the event the explosive device should fire inadvertently as it is being removed from the well bore at the surface, it can be a significant hazard to workers and equipment that is located at the surface. It is desirable therefore, to ensure the provision of a novel downhole blast control system that effectively prevents inadvertent firing of an explosive device while being run into the well bore, retrieved from the well bore or handled at the surface during insertion or retrieval.

Another significant problem in the firing of downhole explosive charges is that they are typically controlled by means of wireline equipment for downhole positioning and retrieval. The operating system for actuating the explosive firing device must be manipulated by means of surface controlled equipment with the hope of setting off the detonator with the downhole device accurately located at a predetermined depth within the well bore. Many different types of explosive control devices require the wireline equipment to be picked up and set down a number of times in order to achieve the desired mechanical result, i.e. the firing of a firing pin, shearing of a shear pin, etc. It is often difficult to ensure accurate positioning of a downhole explosive device so that the desired subsurface operation is accurately and safely carried out. It is desirable therefore, to provide a downhole blast control system that effectively ensures accurate positioning of an explosive device at a desired depth within a well bore and selective electronic firing of the explosive device only when predetermined parameters of firing control have been successfully met. It is also desirable to provide a novel electronic blast system that ensures that a downhole explosive device which fails to fire or is not fired for any number of reasons can be efficiently and safely retrieved from the downhole environment without compromising the safety of the well equipment or the well personnel at the surface.

Electronic well control equipment has been developed which utilizes time and motion as determining factors for positioning of explosive equipment at a selected depth within the well bore and for achieving its explosive detonation for accomplishing work. In existing electronic control devices, electronic time and motion responsive signals alone are not considered sufficiently adequate safety features for dangerous devices such as those utilizing downhole explosives for explosive energized well activities. It is desirable, therefore, to provide a downhole blast control system which establishes a plurality of electronic parameters all of which must be satisfactorily met before the explosive device can be electrically initiated. These electronic parameters include hydrostatic pressure signals and well fluid temperature signals which can initiate electronic firing signals only when the detonation control system is located at designed depth within the well bore.

When downhole detonation of explosive devices is accomplished, especially for casing and formation perforation during well completion activities, it is desirable to know the condition of the well bore and production formation before, during and immediately following detonation of the explosive. Heretofore, the condition of the formation has been determined largely by running well data tools into the wellbore to formation depth after the blasting tool has been retrieved. Obviously, after a delay of this duration the production formation will have stabilized so that certain data, such as formation recovery pressure and production rate cannot be immediately determined. It is desirable therefore to provide a novel electronic blast control tool which incorporates a solid state non-volatile memory which is capable of receiving and storing many thousands of well data sets, including time, well fluid pressure and well fluid temperature. After recovery of the blast control tool the memory can be dumped to a computer memory for storage and later processing. These well data sets include well data before, during and immediately following blasting to provide a full range of data that evidences the condition of the formation to be produced.

SUMMARY OF THE INVENTION

It is a principle feature to provide a novel electronic control system for downhole explosives which establishes multiple firing parameters, all of which must be met before an explosive charge will be permitted to detonate.

It is also a feature of this invention to provide a novel electronic blast control system for downhole well operations which will permit firing of the detonator of a downhole explosive charge only when selective firing activation occurs after a predetermined initial timed delay period has expired and before an end time period has been reached, thereby providing a time window establishing the only time period within which the explosive detonation can take place.

It is also a feature of this invention to provide a novel electronic blast control system that is responsive to hydrostatic well pressure such that a detonator for a downhole explosive charge is permitted to fire only when hydrostatic pressure has reached a predetermined minimum pressure depth such as the calculated formation pressure at the designed depth of the well zone of interest.

It is also a feature of this invention to provide a novel electronic blast control system for downhole detonation of explosive charges which is responsive to well fluid temperature such that the detonator may be initiated only after a predetermined well fluid temperature has been detected, being the well fluid temperature relating to formation temperature at or near the downhole zone of interest.

It is an even further feature of this invention to provide a novel electronic blast control system for downhole well operations which provides electronic logic signals responsive to movement of a downhole well tool and thus prevents detonation of the explosive device by appropriate logic signals only after the well tool has ceased movement within the well bore for a predetermined period of time.

It is another important feature of this invention to provide an electronic blast control system for downhole well operations which incorporates an on-board non-volatile memory to receive and store downhole information in data sets of time, temperature, and pressure in a manner that can be transferred or "dumped" to a computer upon retrieval of the blast control instrument and later processed for analysis. The data sets are acquired at high frequency so that data are acquired before, during, and immediately following the blasting operation so that well and formation production conditions and capability can be determined from subsequent computer analysis thereof.

Briefly, an electronic blast control system incorporating the various features of this invention is in the form of a small elongate blast control tool which is adapted to be run into a well casing or a well bore by means of conventional wireline service equipment. The upper end of the tool is provided with a threaded or other suitable connection for assembly thereof to the lower end of a wireline running tool. It incorporates a battery section of sufficient dimension and capacity for the electronic power that is needed for operation of the blast control system in the downhole environment and for accomplishing electrical initiation of the detonation of the downhole explosive device. The apparatus incorporates a pressure tight housing within which is located a memory module having the capacity for receiving and storing many thousands of sets of time, temperature, and pressure data in a solid state non-volatile memory. This memory module is adapted to receive downhole data before, during, and after detonation of the explosive device so that well conditions responsive to the detonation and indicating recovery and productivity of the production formation can be carefully analyzed after retrieval of the tool from the wellbore. The memory module is also capable of transferring its stored data to the memory of a computer after recovery of the tool from the well bore in order that the data may be analyzed or otherwise processed by a computer program and intelligently displayed for inspection by personnel in control of the well being serviced.

The downhole tool is also provided with an electronic motion sensor module which, like the on-board electronic memory, derives its electrical power from the battery section of the unit. The motion sensor circuit provides logic signals responsive to motion that prevent electronic firing of the detonator as long as motion is occurring and for a predetermined period of time after motion of the instrument within the well bore has ceased. This time period enables the blast control system to be positioned at the desired well depth and remain statically positioned for a period of time before firing of the detonator can occur. Thus, if the tool should become temporarily stuck while its running is being accomplished, its timing sequence will automatically restart upon upward or downward movement of the tool within the well. Also, this feature prevents detonation of the explosive device when the tool is being handled by well service personnel as it is introduced into the well or retrieved from the well.

A clock timer module is also provided which establishes a firing time window only within which electrically energized firing of the detonator can occur. A pressure sensor module is also provided for the instrument which ensures that firing of the detonator can occur until predetermined hydrostatic pressure of the well fluid has been detected, being the hydrostatic pressure that is calculated to be present at the desired depth within the well bore. A temperature sensor module is also employed which detects the temperature of the fluid within the well bore and thus, indirectly detects the temperature of the surrounding formation. The temperature sensor provides electronic logic signals that prevent firing of the detonator until such time as detected temperature is above a predetermined minimum.

The instrument also includes a central processing unit "CPU" or fire control which receives and processes electronic logic signals being continuously received from the motion sensor, clock timer, pressure sensor, and temperature sensor modules. The CPU generates an electronic detonation signal permitting electrical initiation of the detonator by the electrical energy of the battery only when the signal output of these sensors and the clock timer collectively provide the CPU with firing logic signals which establish approval for the downhole detonation. If a logic signal from either of these control modules is in the nonfiring mode, the CPU will be unable to output a firing signal and the blast control system will remain in its "safe" mode.

Beneath the pressure housing of the blast control tool, there is provided a shock absorber which protects the tool from the severe hydraulic shock that is developed during detonation of the downhole explosive. Beneath the shock absorber a detonator is provided to which is connected one or more blast joints that are designed for accomplishment for predetermined explosive energized downhole work such as casing perforation, setting of packers etc.

DETAILED DESCRIPTION OF PREFERRED EMBODIMENT

Figure 1:
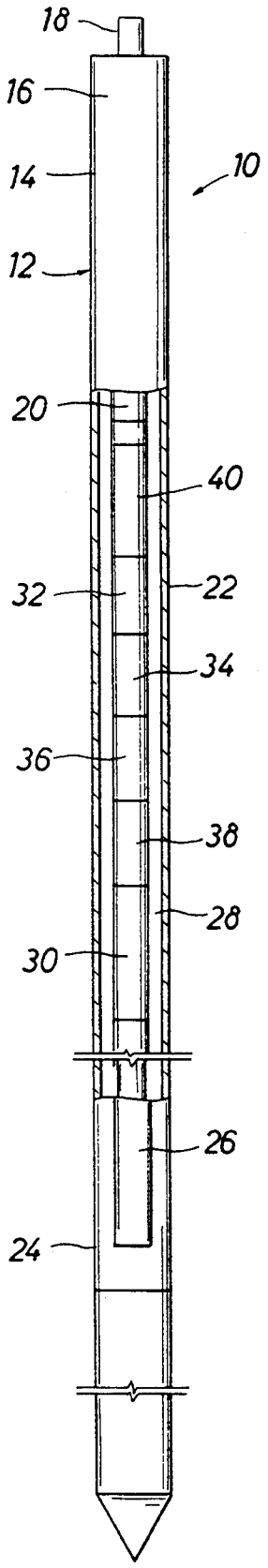
FIG. 1 is a partial sectional view of an electronic blast control system which is constructed in accordance with the present invention.

Referring now to the drawings and first to FIG. 1, an electronic blast control system incorporating the features of this invention is illustrated generally at 10 and incorporates an elongate instrument body shown generally at 12 having an upper housing sub 14 within which is located a battery 16. The upper housing sub 14 is provided with an externally threaded upper connection member 18 which is adapted for connection of the blast control instrument to a conventional wireline running tool, a part thereof being shown at 15 to thus enable the instrument 10 to be run into a well bore and positioned at a predetermined depth within the well for blasting operations. The upper housing sub 14 also includes an externally threaded downwardly extending connector projection 20 to enable its physical and electronic coupling with other electronic components of the instrument.

The housing structure of the instrument also includes an intermediate pressure housing section 22 which is coupled and sealed in relation with the upper housing sub and which is also coupled and sealed in relation with the uppermost one of one or more detonator blast joints containing a detonator 26 which is electrically initiated by means of electrical current from the storage battery 16 under circumstances where multiple safe parameters of the blast control have been met so that electrical initiation of the detonator is permitted. The detonator, upon initiation will then achieve typically first order detonation of one or more explosive charges that are contained within the blast joint or joints for achieving the explosive initiated downhole work that is desired.

The pressure tight housing 22 defines an internal chamber 28 having therein a plurality of electronic control modules which sense programmed well conditions such as fluid temperature and hydrostatic pressure, which sense motion of the instrument as it traverses the well bore while being inserted into or removed from the well and which provides a predetermined timed sequence within which the downhole blasting operation is permitted to occur. These pressure, temperature and motion sensors and the clock timer provide electronic logic pulses which define safe and unsafe parameters for downhole blasting operations. These electronic logic signals are input to a central processing unit 30 having a microprocessor providing a firing signal output which controls battery current energization of the detonator circuit for electronic initiation of the detonator. The detonator will then initiate the explosive charge or charges which are typically first order explosive devices but which may comprise any other suitable explosive device for the work that is intended.

In preparation for downhole blasting activities, the blasting device is handled during transportation to the well site and is then handled by well personnel in preparation for its introduction into the well bore. After it is introduced into the well bore, typically by means of conventional wireline equipment, it must be run through the well bore to the designed depth for explosive detonation and must be secured relative to the well casing prior to detonation. During handling and running of the downhole blasting tool, it is critical that explosive detonation not occur. It is also desirable that explosive detonation occur only when the blasting tool has been set at its predetermined depth within the well bore so that blast-induced activities will be accurately performed. For these reasons, according to the teachings of the present invention, the electronic blast control system of the present invention is provided with a plurality of sensors and a clock timer that each provide an output of logic signals reflecting sensed conditions. These logic output signals are conducted to the CPU 30 and are processed thereby. When predetermined logic output signals are received by the CPU, its signal processing will yield a CPU output signal causing battery current to be placed across the detonator circuit thereby initiating the detonator and inducing controlled blasting activity. If the output signals of the clock timer or any of the well condition sensors are not in accordance with predetermined conditions that are necessary for blasting activity, CPU processing of the signals will yield a logic output signal that prevents detonator circuit energization by the battery section of the tool. The electronic blast control system includes a motion sensor circuit 32 which detects any movement of the tool as it is being handled at the surface and run into the well bore. The motion sensor also detects movement of the tool as it is being extracted from the well bore under conditions where, for any of a number of reasons, detonation will not have occurred. The motion sensor circuit includes a timing sequence which is initiated each time motion of the tool ceases within the well bore. A timing sequence of any suitable duration may be employed which is suitable to the user. Thus, if the tool becomes temporarily stuck within the well bore during running and thereby becomes motionless, even though it is not designed depth for detonation, the motion sensor circuit will not yield a logic signal permitting firing of the detonator until the timing sequence period has completed. Thus, should the tool become stuck within the well casing during running, the timing sequence of the motion sensor circuit will begin. If the tool is subsequently moved upwardly or downwardly, such as what typically occur during activities to unstick the tool, the motion sensor timing sequence will become reset. Accordingly, before the detonator can be fired, the timing sequence of the motion sensor must have run its course and remain stable for a period exceeding the duration of the timing sequence.

It is desirable that the downhole blasting system be capable of detonating only during a predetermined period of time. It is necessary that initiation of the detonator not occur until a pre-determine time that is sufficiently far in advance so that the blasting tool can be properly positioned at its designed depth and proper orientation within the well casing. It is also desirable that there be a capability of pre-setting a timed period during which detonator initiation can occur and before which and after which initiation of the detonator cannot occur. Thus, if the detonator and its various associated apparatus has remained downhole for a period that is sufficiently long to exceed a predetermined time duration, for example, two hours, then it is desirable to safely prevent initiation of the detonator, thereby enabling the electronic blast control system together with the detonator and blast joints to be removed from the well. To accomplish this feature, a clock timer circuit 34 is provided within the chamber 28 of the pressure containing housing 22. The clock timer circuit derives its electrical energy from the battery 16 and provides a logic output signal having a predetermined logic state when the clock timer circuit is within the predetermined firing period and an opposite logic state when the clock timer circuit is registering a time that is either before or after the predetermined firing period. The logic output signals of the clock timer circuit are transmitted to the CPU for processing so that the firing signal that is output by the CPU can occur only when the timing sequence is within the firing period that is set at the surface by operating personnel.

Figure 2:
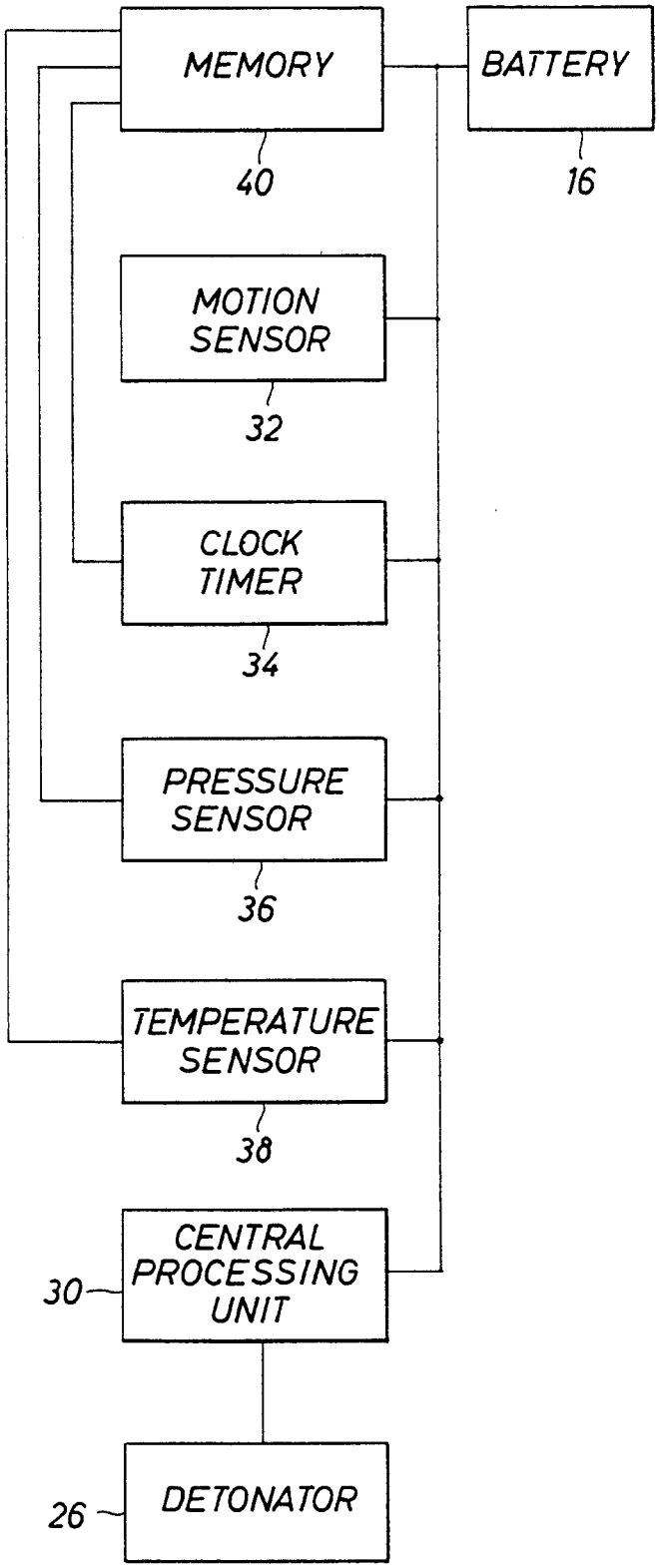
FIG. 2 is a block diagram electronic schematic illustrating the interrelated firing control components of the blast control system of FIG. 1.

In the downhole environment the well casing will contain a level of drilling fluid or completion fluid which will develop hydrostatic pressure within the well casing that is directly responsive at which the depth at which the hydrostatic pressure is taken. Obviously, hydrostatic pressure at any predetermined depth within the well casing can be quite accurately identified. As an additional safety feature, the electronic blast control system of the present invention, shown by way of elevation in FIG. 1 and shown schematically in FIG. 2, is provided with a pressure sensor circuit 36 which is energized by the battery 14 and which senses hydrostatic pressure to which the blast control system is subjected. The pressure sensor circuit 36 provides an electronic logic output reflecting the hydrostatic pressure to which the tool is subjected at any point in time. This logic output is conducted to the CPU which processes these signals along with other logic signals. The circuit is capable of being pre-set to a predetermined hydrostatic pressure range such that when hydrostatic pressure is within the predetermined range, such that when hydrostatic pressure is within the predetermined range a firing signal can be output by a CPU. If the hydrostatic pressure being sensed is outside the predetermined range, then the logic signal being received by the CPU will be such that the CPU cannot provide a firing signal, but rather, will provide a "safe" signal preventing initiation of the detonator 26 by electrical energy from the battery 16. Thus, well servicing personnel will set the predetermined firing pressure range of the pressure sensor for a rather narrow range of hydrostatic pressure that is calculated to be present at the well depth where firing of the blast joints or blasting system should occur. This provides assurance that the electronic blast control system and its downhole explosive system will be properly located at a designed depth within the well bore before a firing control sequence can be initiated by the CPU.

Earth formations will typically have higher temperatures at increasing formation depths. Thus, at a designed depth within a well bore the temperature of the well fluid, which will be directly representative of formation temperature, will have a known narrow range of temperature values. As a further safety feature, the electronic blast control system of this invention is provided with a temperature sensor circuit 38 having the capability of detecting the temperature of the well fluid. This temperature sensor circuit has the capability of being preset with a narrow firing temperature range which will encompass calculated or measured temperature at the predetermined firing depth of the downhole explosive system. When the fluid temperature being sensed is within the predetermined firing range, a logic output signal of the temperature sensor will be conducted to the CPU for processing. As long as the temperature being sensed is within the firing range, the logic output signal received by the CPU will enable the CPU to output a firing signal. If the temperature being sensed by circuit 36 is outside of the firing temperature range, such as would occur if the electronic blast control system is not located at designed well depth, the CPU will output a "safe" signal, thereby preventing initiation of the detonator by the electrical energy of the battery 16.

In order for the CPU to output a "firing" signal, the respective logic signals output by the motion sensor circuit, the clock timer circuit, the pressure sensor and the temperature sensor must reflect positioning of the downhole blasting system at designed well depth and within a predetermined timing sequence in order for the downhole blasting system to fire. If the blasting system is not fired, or for some reason fails to fire, the tool is rendered safe for extraction from the well simply by permitting expiration of the predetermined sequence that is programmed into the clock timer. Then, as the blast control system and its associated blasting tool is moved towards the surface during extraction procedures, the other safety circuits will come into play. The motion sensor circuit will detect upward motion of the tool and will change its logic output signal to the "safe" mode, thereby preventing output of a firing signal by the CPU. Likewise, as the tool is moved uphole, the pressure sensor circuit and the temperature sensor circuit will detect hydrostatic pressure and well fluid temperature that is outside of the prescribed range for the firing sequence. These circuits will then also change their respective logic output signals to the "safe" mode, thereby preventing the CPU having a "firing" mode output signal that permits initiation of the detonator 26 by the electrical energy of the battery.

As the electronic blast control is being run downhole, it is positioned for firing and is fired, it is desirable to identify various downhole conditions of pressure and temperature for determination of formation conditions. It is also desirable to identify pressure and temperature conditions immediately after firing as further evidence of formation conditions. These features are effectively provided for by the electronic blast control system of the present invention which incorporates a solid-state, non-volatile memory circuit 40 which continuously receives the output logic signals of the pressure and temperature circuits and also receives the output signals of the clock timer circuit in order that the pressure and temperature signals may be correlated with time. The data format of the memory circuit 40 is such that multiple thousands of sets of Delta time, temperature, and pressure are stored in the solid-state, non-volatile memory. After the electronic blast control system has been removed from the well, the memory circuit 40 is selectively coupled with the input of a computer having a program and a memory adapted for receiving and processing the multiple data sets of the memory circuit. Thus, the computer can provide processed downhole data from the well, reflecting well conditions before and after blasting as well as well conditions. This information may be plotted graphically or rendered by the computer in any suitable form that is desired for analysis.

I claim:

1. A method for controlling detonation of explosives in the down-hole environment of a well bore having a fluid therein establishing hydrostatic pressure and having a temperature determined by the surrounding earth formation, said method comprising;

(a) providing an electronic blasting control instrument having a central processing unit (CPU) being electronically coupled for firing control to a detonator for an explosive charge, said CPU having a clock timer, a motion sensor, a temperature sensor and a hydrostatic pressure sensor each providing electronic logic signal output to said CPU;

(b) programming said clock timer with a predetermined firing time prior to which firing of said detonator by said CPU is prevented and a predetermined end firing time after which firing of said detonator by said CPU is prevented, said firing and end firing times defining a time window during which firing of said detonator by said CPU is permitted;

(c) programming said pressure sensor with a predetermined firing pressure range within which said CPU can fire said detonator for said explosive charge and outside of which said CPU is unable to fire said detonator for said explosive charge;

(d) programming said temperature sensor with a predetermined firing temperature range within which said CPU can fire said detonator and outside of which said CPU is unable to fire said detonator;

(e) programming said motion sensor to establish a motion time delay period of predetermined duration and a firing time period of predetermined duration upon cessation of motion of said electronic blasting control instrument within said well bore and permitting firing of said detonator only after expiration of said firing time delay period and during said firing time period;

(f) moving said electronic firing control instrument through said well bore to a predetermined depth therein; and (g) initiating firing said detonator by selective firing control of said CPU to achieve selectively positioned and controlled detonation of said explosive charge, said firing being permitted by said CPU only when CPU controlled firing thereof is initiated within said time window, said firing pressure range, said firing temperature range and within said firing time period.

2. The method of claim 1, wherein electronic signals are transmitted to said CPU by said motion sensor, clock timer, pressure sensor and temperature sensor only when the motion, time, pressure and temperature being sensed thereby are within the respective predetermined ranges established by said programming, said CPU being enabled to initiate a firing sequence only upon receiving electronic signals from said clock timer and all of said sensors, said method further comprising;

with said electronic blasting control instrument within said well bore and after said clock timer has reached said predetermined firing time and prior to said clock timer and all of said sensors, said method further comprising;

with said electronic blasting control instrument within said well bore and after said clock timer has reached said predetermined firing time and prior to said clock time reaching said end firing time, transmitting a clock controlled firing signal to said CPU.

3. The method of claim 2, wherein said method further comprises:

transmitting a firing pressure signal to said CPU from said pressure sensor when the hydrostatic pressure being sensed is within said predetermined firing pressure range.

4. The method of claim 3, wherein said method further comprises:

transmitting a firing temperature signal to said CPU from said temperature sensor when the temperature being sensed thereby is within said predetermined firing temperature range.

5. The method of claim 4, wherein said method further comprises:

transmitting a motion controlled firing signal from said motion sensor to said CPU after expiration of said time delay period and prior to expiration of said firing time period.

6. The method of claim 5, wherein said method further comprises:

(a) processing said clock controlled firing signal, said firing pressure signal, said firing temperature signal and said motion controlled firing signal by said CPU;

(b) providing a CPU firing signal;

(c) transmitting a selective firing signal to said CPU;

(d) comparing said CPU firing signal and said selective firing signal; and (e) transmitting a detonation signal from said CPU to said detonator for initiation of said detonator and said explosive charge.

7. An electronic blasting control system for controlling initiation of downhole explosive induced activity within a well bore having a well fluid therein establishing hydrostatic pressure and formation temperature, comprising:

(a) a central processing unit (CPU) being electronically coupled to an electronically fired detonator for a downhole explosive system;

(b) a clock/timer circuit being electronically coupled with said CPU and being programmable for establishment of a firing time and an end firing time defining a firing time window;

(c) a pressure sensor circuit being electronically coupled with said CPU and being adapted for sensing the hydrostatic pressure of well fluid within said well bore, said pressure sensor circuit being programmable to detect predetermined minimum and maximum hydrostatic pressures of well fluid within said well bore and to define therebetween a predetermined firing pressure window and to transmit a firing signal to said CPU only when sensed hydrostatic pressure is within said predetermined firing pressure window;

(d) a temperature sensor circuit being electronically coupled with said CPU and sensing the temperature of said well fluid within said well bore, said temperature sensor circuit being programmable to detect a predetermined well fluid temperature representing the formation temperature at a preselected well depth and to transmit a firing signal to said CPU when the detected temperature is at or above said predetermined temperature;

(e) a motion sensor circuit being electronically coupled with said CPU and establishing a time delay period upon cessation of motion of said blast control system within said well bore, upon expiration of said time delay period said motion sensor transmitting a firing signal to said CPU; and (f) wherein said CPU, upon receiving said firing signals from said clock timer circuit, pressure sensor circuit, temperature sensor circuit and motion sensor circuit, processing said firing signals and transmitting an electronic firing signal to said detonator for initiation of said downhole explosive induced activity.

8. The electronic blasting control system of claim 7, including:

a solid state non-volatile electronic memory circuit being electronically coupled with said clock/timer, pressure sensor and temperature circuits for storing multiple sets of time, temperature and pressure data received therefrom for analysis after recovery of said electronic blasting control system from said well bore.

9. The electronic blasting control system of claim 8, wherein;

said solid state non-volatile electronic memory is adopted for input of said multiple sets of time, temperature and pressure to a computer for computer analysis thereof.

10. The electronic blasting control system of claim 8, wherein said solid state nonvolatile memory defines a computer coupling for electronically coupling with an input port of a computer for transmitting said stored multiple data sets to the electronic memory of the computer for later computer analysis and display thereof.

11. The electronic blasting control system of claim 7, including:

a shock absorber located between said electronic blasting control system and the explosive controlled thereby for protecting said electronic blasting control system from explosive induced shock.

12. The electronic blasting control system of claim 8, including:

a battery section having a battery circuit being electrically coupled for electronic power with said solid state non-volatile electronic memory, said motion sensor circuit, said clock/timer circuit, said pressure sensor circuit, said temperature sensor circuit and said central processing unit and being selective electrically coupled with said detonator for initiation thereof under control of said central processing unit.

13. A blast control tool having electronic downhole blast control system comprising:

(a) a pressure tight housing adapted at one end for connection to a running tool and adapted at the opposite end for connection to a blast joint containing a detonator and an explosive;

(b) an electronic firing circuit within said housing for electrical initiation of said detonator of said downhole blast joint;

(c) a central processing unit within said housing and adapted to output an electronic firing signal to said electronic firing circuit;

(d) a motion sensor circuit within said housing and having a signal output coupled with said central processing unit and providing a firing logic signal to said central processing unit only after said blast control tool has remained motionless for a predetermined period of time;

(e) a clock/timer circuit within said housing and having a signal output coupled with said central processing unit and providing a firing logic signal to said central processing unit only during a predetermined time period;

(f) a pressure sensor circuit within said housing and having a signal output coupled with said central processing unit and providing a firing logic signal to said central processing unit only when sensed hydrostatic pressure of well fluid is above a predetermined pressure;

(g) a temperature sensor circuit within said housing and having a signal output coupled with said central processing unit and providing a firing logic signal to said central processing unit only when well fluid temperature sensed thereby is above a predetermined temperatures; and (h) said central processing unit being enabled to output said electronic firing signal to said detonator for initiation thereof only when firing logic signals are simultaneously received from said motion sensor, clock/timer pressure sensor and temperature sensor circuits.

14. The electronic blast control tool of claim 13, including:

a solid state non-volatile electronic memory circuit being electronically coupled with said clock/timer, pressure sensor and temperature circuits for storing multiple sets of time, temperature and pressure data received therefrom for analysis after recovery of said electronic blasting control system from said well bore.

15. The blast control tool of claim 14, wherein:

said solid state non-volatile electronic memory is adapted for input of said multiple sets of time, temperature and pressure to a computer for computer analysis thereof.

16. The blast control tool of claim 13:

wherein said solid state non-volatile memory defines a computer coupling for electronically coupling with an input port of a computer for transmitting said stored multiple data sets to the electronic memory of the computer for later computer analysis and display thereof.

17. The blast control tool of claim 13, including:

a shock absorber located between said electronic blasting control system and the explosive controlled thereby for protecting said electronic blasting control system from explosive induced shock.

18. The blast control tool of claim 13, including:

a battery section having a battery circuit being electrically coupled for electronic power with said solid state non-volatile electronic memory, said motion sensor circuit, said clock/timer circuit, said pressure sensor circuit, said temperature sensor circuit and said central processing unit and being selective electrically coupled with said detonator for initiation thereof under control of said central processing unit.

* * * * *